US010504410B2

(12) United States Patent
Park et al.

(10) Patent No.: US 10,504,410 B2
(45) Date of Patent: Dec. 10, 2019

(54) DISPLAY APPARATUS AND DRIVING METHOD THEREOF

(71) Applicant: Samsung Display Co., Ltd., Yongin-si, Gyeonggi-do (KR)

(72) Inventors: Sungjae Park, Wonju-si (KR); Jinpil Kim, Suwon-si (KR); Jung-won Kim, Seoul (KR); Namjae Lim, Gwacheon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 177 days.

(21) Appl. No.: 15/417,827

(22) Filed: Jan. 27, 2017

(65) Prior Publication Data

US 2017/0221404 A1 Aug. 3, 2017

(30) Foreign Application Priority Data

Jan. 28, 2016 (KR) ..... 10-2016-0010795

(51) Int. Cl.

| | |
|---|---|
| ***G09G 3/36*** | (2006.01) |
| ***G09G 3/20*** | (2006.01) |
| ***G09G 3/34*** | (2006.01) |
| ***G09G 5/04*** | (2006.01) |

(52) U.S. Cl.

CPC ..... *G09G 3/2092* (2013.01); *G09G 3/3406* (2013.01); *G09G 5/04* (2013.01); *G09G 2300/0452* (2013.01); *G09G 2320/0242* (2013.01); *G09G 2320/0276* (2013.01); *G09G 2320/0626* (2013.01); *G09G 2320/0666* (2013.01); *G09G 2320/0673* (2013.01); *G09G 2320/0693* (2013.01); *G09G 2340/06* (2013.01); *G09G 2360/16* (2013.01)

(58) Field of Classification Search

None

See application file for complete search history.

(56) References Cited

U.S. PATENT DOCUMENTS

| | | | | |
|---|---|---|---|---|
| 7,583,279 | B2 | 9/2009 | Brown Elliott et al. | |
| 2005/0140614 | A1* | 6/2005 | Baek | G09G 3/3648 345/87 |
| 2016/0035292 | A1 | 2/2016 | Lee et al. | |
| 2016/0322432 | A1* | 11/2016 | Yang | H01L 27/3218 |

FOREIGN PATENT DOCUMENTS

| | | |
|---|---|---|
| KR | 10-1471154 | 12/2014 |
| KR | 10-1521519 | 5/2015 |

* cited by examiner

*Primary Examiner* — Carl Adams

(74) *Attorney, Agent, or Firm* — Lewis Roca Rothgerber Christie LLP

(57) ABSTRACT

A display apparatus includes a mapper configured to map a primary color data including information on three primary colors to generate mapping primary data including red, green, and blue information and mapping white data including white information, a splitter configured to generate split primary data based on the mapping primary data and one gamma curve, and to generate split white data based on the mapping white data and another gamma curve different from the one gamma curve, and a compensator configured to compensate for the split primary data based on a target color coordinate and a primary color coordinate corresponding to a color coordinate of the split primary data to generate compensated primary data.

17 Claims, 12 Drawing Sheets

FIG. 5B

| Gamma value of the second gamma curve | 2.2 | 2.69 | 3.46 | 4.84 | 6.05 |
|---|---|---|---|---|---|
| Wash out index | 15.27 | 13.97 | 12.97 | 11.37 | 11.34 |

DISPLAY APPARATUS AND DRIVING METHOD THEREOF

CROSS-REFERENCE TO RELATED APPLICATION

This application claims priority to and the benefit of Korean Patent Application No. 10-2016-0010795, filed on Jan. 28, 2016, the content of which is hereby incorporated by reference in its entirety.

BACKGROUND

1. Field of Disclosure

Aspects of the present disclosure relate to a display apparatus and a driving method thereof.

2. Description of the Related Art

In general, a liquid crystal is injected between a lower substrate of a liquid crystal display apparatus and an upper substrate of the liquid crystal display apparatus in which a transparent electrode is formed, and upper and lower polarization plates are respectively disposed on outer surfaces of the upper and lower substrates. The liquid crystal display apparatus is generally driven by changing an alignment of the liquid crystal between the upper substrate and the lower substrate and controlling a transmittance of the liquid crystal.

In addition, in order to implement a color display, the liquid crystal display apparatus includes a liquid crystal display panel provided with sub-pixels respectively representing three primary colors such as red, green, and blue. Recently, in order to increase brightness of a display image, a liquid crystal display panel, which further includes white sub-pixels, has been proposed.

SUMMARY

Aspects of embodiments of the present disclosure are directed toward a display apparatus having improved side visibility and color shift phenomenon and a driving method thereof.

According to embodiments of the inventive concept, there is provided a display apparatus including: a mapper configured to map a primary color data including information on three primary colors to generate mapping primary data including red, green, and blue information and mapping white data including white information; a splitter configured to generate split primary data based on the mapping primary data and one gamma curve, and to generate split white data based on the mapping white data and another gamma curve different from the one gamma curve; and a compensator configured to compensate for the split primary data based on a target color coordinate and a primary color coordinate corresponding to a color coordinate of the split primary data to generate compensated primary data.

In an embodiment, the compensator is configured to calculate a shifting color coordinate obtained by shifting the primary color coordinate based on a white color coordinate corresponding to a color coordinate of the split white data and the target color coordinate, and to compensate for the split primary data based on the shifting color coordinate to generate the compensated primary data.

In an embodiment, the compensator is configured to calculate a primary luminance value of the split primary data and a white luminance value of the split white data, to calculate a primary beta value and a white beta value based on the primary luminance value and the white luminance value, and to generate the compensated primary data based on the primary beta value and the white beta value.

In an embodiment, the primary beta value and the white beta value satisfy the following equations of $$MB = \frac{ML}{ML + WL} \text{ and } WB = \frac{WL}{ML + WL},$$

where MB denotes the primary beta value, WB denotes the white beta value, ML denotes the primary luminance value, and WL denotes the white luminance value.

In an embodiment, an x coordinate, a y coordinate, and a z coordinate of the shifting color coordinate satisfy the following equation of $$\begin{pmatrix} SX \\ SY \\ SZ \end{pmatrix} = \begin{pmatrix} TX - WB \cdot WX \\ TY - WB \cdot WY \\ TZ - WB \cdot WZ \end{pmatrix} \cdot \frac{1}{MB},$$

where SX denotes the x coordinate of the shifting color coordinate, SY denotes the y coordinate of the shifting color coordinate, SZ denotes the z coordinate of the shifting color coordinate, TX denotes an x coordinate of the target color coordinate, TY denotes a y coordinate of the target color coordinate, TZ denotes a z coordinate of the target color coordinate, WX denotes an x coordinate of the white color coordinate, WY denotes a y coordinate of the white color coordinate, and WZ denotes a z coordinate of the white color coordinate.

In an embodiment, the display apparatus further includes a scaler configured to analyze the mapping primary data and the mapping white data to calculate a scaling value, and configured to scale down grayscale values of the mapping primary data and the mapping white data in accordance with the scaling value to generate scalar primary data and scalar white data, wherein the splitter is further configured to receive the scalar primary data and the scalar white data, to convert the scalar primary data to the split primary data based on the one gamma curve, and to convert the scalar white data to the split white data based on the another gamma curve.

In an embodiment, the display apparatus further includes: a backlight configured to generate a light; and a back light controller configured to drive the backlight, wherein the backlight controller is configured to generate a backlight control signal to scale up a luminance of the light generated by the backlight in response to the scaling value.

In an embodiment, the display apparatus further includes a renderer configured to sub-pixel render the compensated primary data and the compensated white data to respectively generate rendered primary data and rendered white data.

In an embodiment, the renderer is configured to re-sample the compensated primary data and the compensated white data to respectively generate the rendered primary data and the rendered white data.

In an embodiment, the display apparatus further includes a display panel including red, green, blue, and white sub-pixels, wherein the red, green, blue, and white sub-pixels are configured to receive data voltages obtained based on different data among respective ones of red, green, and blue image data of the rendered primary data, and the white sub-pixel is configured to receive a data voltage obtained based on the rendered white data.

In an embodiment, the splitter is configured to generate the split primary data based on the mapping primary data and a first gamma curve within a first period, to generate the split white data based on the mapping white data and a second gamma curve different from the first gamma curve within the first period, to generate the split primary data based on the mapping primary data and the second gamma curve within a second period temporally succeeding the first period, and to generate the split white data based on the mapping white data and the first gamma curve within the second period.

In an embodiment, each of the first and second periods corresponds to at least n frame, and the "n" is a natural number.

In an embodiment, the first gamma curve has a luminance value higher than a reference gamma curve at a same grayscale value, the second gamma curve has a luminance value lower than a reference gamma value at a same grayscale value, and the reference gamma value of the reference gamma curve is about 2.2.

According to embodiments of the inventive concept, there is provided a display apparatus including: a mapper configured to map primary color data including information on three primary colors to generate mapping primary data including red, green, and blue information and mapping white data including white information; a scaler configured to analyze the mapping primary data and the mapping white data to calculate a scaling value, and to scale down grayscale values of the mapping primary data and the mapping white data in accordance with the scaling value to generate scalar primary data and scalar white data; a compensator configured to generate compensated primary data based on a target color coordinate and a color coordinate of the scalar primary data; and a splitter configured to generate split primary data based on the compensated primary data and a first gamma curve, and to generate split white data based on the scalar white data and a second gamma curve different from the first gamma curve.

According to embodiments of the inventive concept, there is provided a method of driving a display apparatus, the method including: mapping primary color data including information on three primary colors; generating mapping primary data including red, green, and blue information and mapping white data including white information; generating split primary data based on the mapping primary data and a first gamma curve; generating split white data based on the mapping white data and a second gamma curve different from the first gamma curve; and compensating the split primary data based on a target color coordinate and a primary color coordinate corresponding to a color coordinate of the split primary data to generate compensated primary data.

In an embodiment, the compensating the split primary data to generate the compensated primary data includes: calculating a shifting color coordinate by shifting the primary color coordinate based on a white color coordinate corresponding to a color coordinate of the split white data and the target color coordinate; and compensating the split primary data based on the shifting color coordinate to generate the compensated primary data.

In an embodiment, the compensating the split primary data to generate the compensated primary data further includes: calculating a primary luminance value of the split primary data and a white luminance value of the split white data; calculating a primary beta value based on the primary luminance value; calculating a white beta value based on the white luminance value; and generating the compensated primary data based on the primary beta value and the white beta value.

In an embodiment, the primary beta value and the white beta value satisfy the following equations of $$MB = \frac{ML}{ML + WL} \text{ and } WB = \frac{WL}{ML + WL},$$

where MB denotes the primary beta value, WB denotes the white beta value, ML denotes the primary luminance value, and WL denotes the white luminance value.

In an embodiment, a x coordinate, a y coordinate, and a z coordinate of the shifting color coordinate satisfy the following equation of $$\begin{pmatrix} SX \\ SY \\ SZ \end{pmatrix} = \begin{pmatrix} TX - WB \cdot WX \\ TY - WB \cdot WY \\ TZ - WB \cdot WZ \end{pmatrix} \cdot \frac{1}{MB},$$

where SX denotes the x coordinate of the shifting color coordinate, SY denotes the y coordinate of the shifting color coordinate, SZ denotes the z coordinate of the shifting color coordinate, TX denotes an x coordinate of the target color coordinate, TY denotes a y coordinate of the target color coordinate, TZ denotes a z coordinate of the target color coordinate, WX denotes an x coordinate of the white color coordinate, WY denotes a y coordinate of the white color coordinate, and WZ denotes a z coordinate of the white color coordinate.

In an embodiment, the first gamma curve has a luminance value higher than a reference gamma curve at a same grayscale value, the second gamma curve has a luminance value lower than a reference gamma value at a same grayscale value, and the reference gamma value of the reference gamma curve is about 2.2.

According to embodiments of the present disclosure, a washout phenomenon, which arises from a white sub-pixel and occurring in an image of a display panel, may be improved (e.g., reduced), and a difference between a front visibility and a side visibility may be reduced by adopting a divisional driving method, which generates a split primary data based on a first gamma curve and a split white data based on a second gamma curve, and by enlarging a value of the gamma value of the second gamma curve.

Also, a color shift phenomenon may be caused by the divisional driving method. In this case, and according to embodiments of the present disclosure, the color shift phenomenon may be improved (e.g., reduced) by the compensated primary date generated by the compensation part.

BRIEF DESCRIPTION OF THE DRAWINGS

The above and other features of the present disclosure will become readily apparent by reference to the following detailed description when considered in conjunction with the accompanying drawings wherein:

FIG. 5A to FIG. 5C are views illustrating an effect obtained by driving a display apparatus according to an exemplary embodiment of the present disclosure;

DETAILED DESCRIPTION

Figure 1:
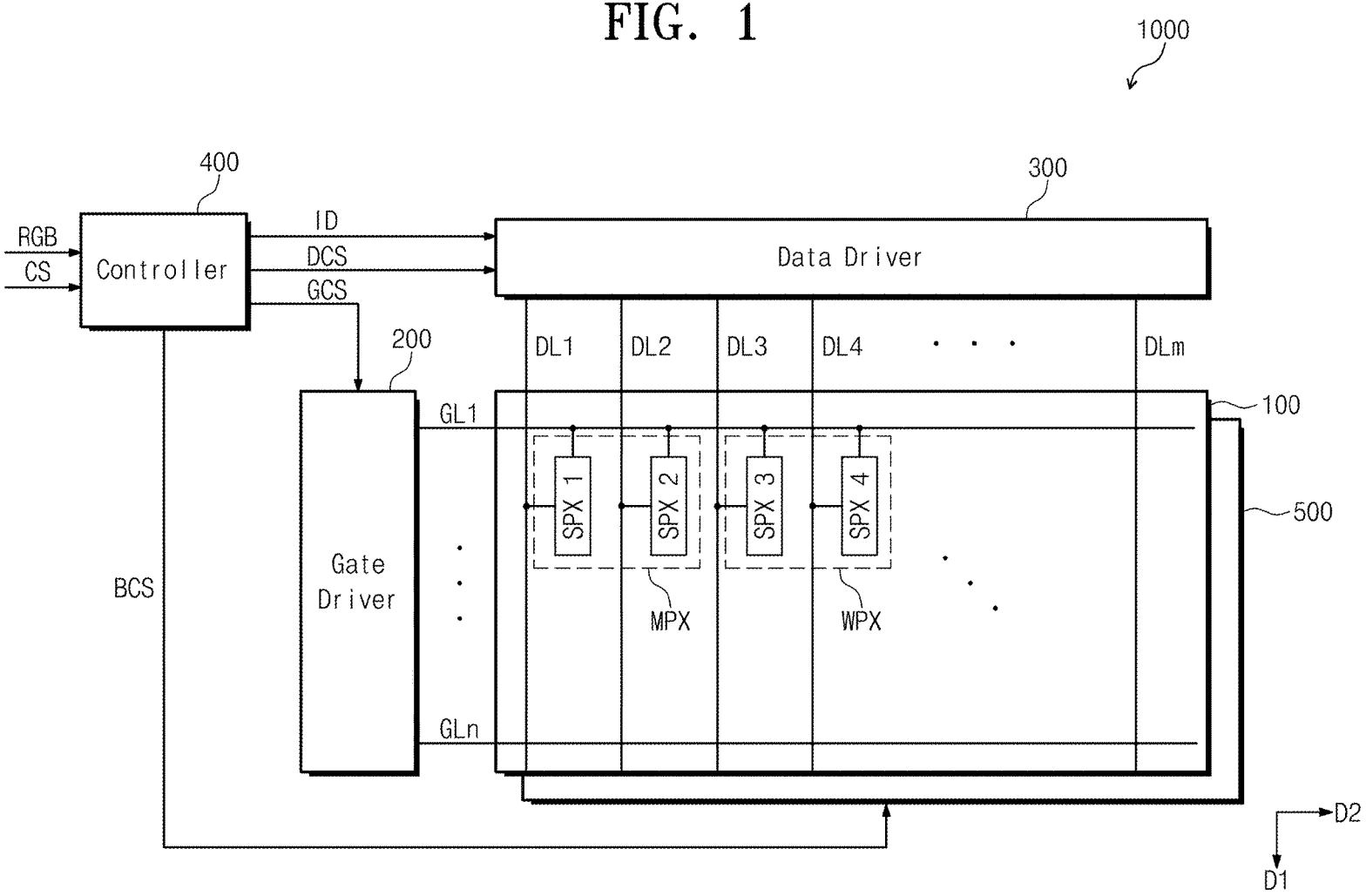
FIG. 1 is a block diagram illustrating a display apparatus according to an exemplary embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure.

Like numerals refer to like elements throughout. In the drawings, the thickness of layers, films, and regions are exaggerated for clarity. Hereinafter, the described technology will be explained in detail with reference to the accompanying drawings.

FIG. 1 is a block diagram illustrating a display apparatus 1000 according to an exemplary embodiment of the present disclosure.

Referring to FIG. 1, the display apparatus 1000 according to the exemplary embodiment of the present disclosure may include a display panel 100 to display an image, a gate driver 200 and a data driver 300 to drive the display panel 100, and a controller 400 to control a drive of the gate driver 200 and the data driver 300.

The controller 400 receives primary color data R, G, B and a plurality of control signals CS from outside of the display apparatus 1000. The controller 400 converts a data format of the primary color data R, G, B to a data format appropriate to an interface specification and a driving mode of the data driver 300 to generate image data ID and outputs the image data ID to the data driver 300.

In addition, the controller 400 generates a data control signal DCS (e.g., an output start signal, a horizontal start signal, and/or the like) and a gate control signal GCS (e.g., a vertical start signal, a vertical clock signal, a vertical clock bar signal, and/or the like).

The data control signal DCS is applied to the data driver 300, and the gate control signal GCS is applied to the gate driver 200.

The gate driver 200 sequentially outputs gate signals in response to the gate control signal GCS provided from the controller 400.

The data driver 300 converts the image data ID to data voltages in response to the data control signal DCS provided from the controller 400. The converted data voltages are applied to the display panel 100.

The display panel 100 includes a plurality of gate lines GL1 to GLn, a plurality of data lines DL1 to DLm, a plurality of primary logic pixels MPX, and a plurality of white logic pixels WPX.

Each of the primary logic pixels MPX may include first and second primary sub-pixels SPX1 and SPX2, and each of the white logic pixels WPX may include a third primary sub-pixel SPX3 and a white sub-pixel SPX4, which is for displaying a white color.

The first to third primary sub-pixels SPX1 to SPX3 may display primary colors. In particular, the first to third primary sub-pixels SPX1 to SPX3 may display different primary colors among red, green, and blue colors. As an example, the first primary sub-pixel SPX1 may display a red color, the second primary sub-pixel SPX2 may display a green color, and the third primary sub-pixel SPX3 may display a blue color.

The primary logic pixels MPX and the white logic pixels WPX serve as an element to display a unit image forming image and a resolution of the display panel DP is determined by the number of the primary logic pixels MPX and the number of the white logic pixels WPX, which are included in the display panel 100.

For ease of illustration, in FIG. 1, one primary logic pixel among the primary logic pixels MPX and one white logic pixel among the white logic pixels WPX are shown, and others of the primary and white logic pixels are omitted.

The gate lines GL1 to GLn extend in a second direction D2 and are arranged substantially in parallel to each other along a first direction D1 substantially vertical to the first direction D1. The gate lines GL1 to GLn are connected to the gate driver 200 to receive the gate signals from the gate driver 200.

The data lines DL1 to DLm extend in the first direction D1 and are arranged substantially in parallel to each other along the second direction D2. The data lines DL1 to DLm are connected to the data driver 300 to receive the data voltages from the data driver 300.

Each of the sub-pixels SPX1 to SPX4 is connected to a corresponding gate line of the gate lines GL1 to GLn and a corresponding data line of the data lines DL1 to DLm.

The display apparatus 1000 may further include a backlight unit (e.g., a backlight) 500. The backlight unit 500 is disposed at a rear of the display panel 100 and faces the display panel 100. The backlight unit 500 receives a backlight control signal BCS generated by the controller 400. The backlight unit 500 generates a light in response to the backlight control signal BCS and provides the light to the display panel 100.

Figure 2A:
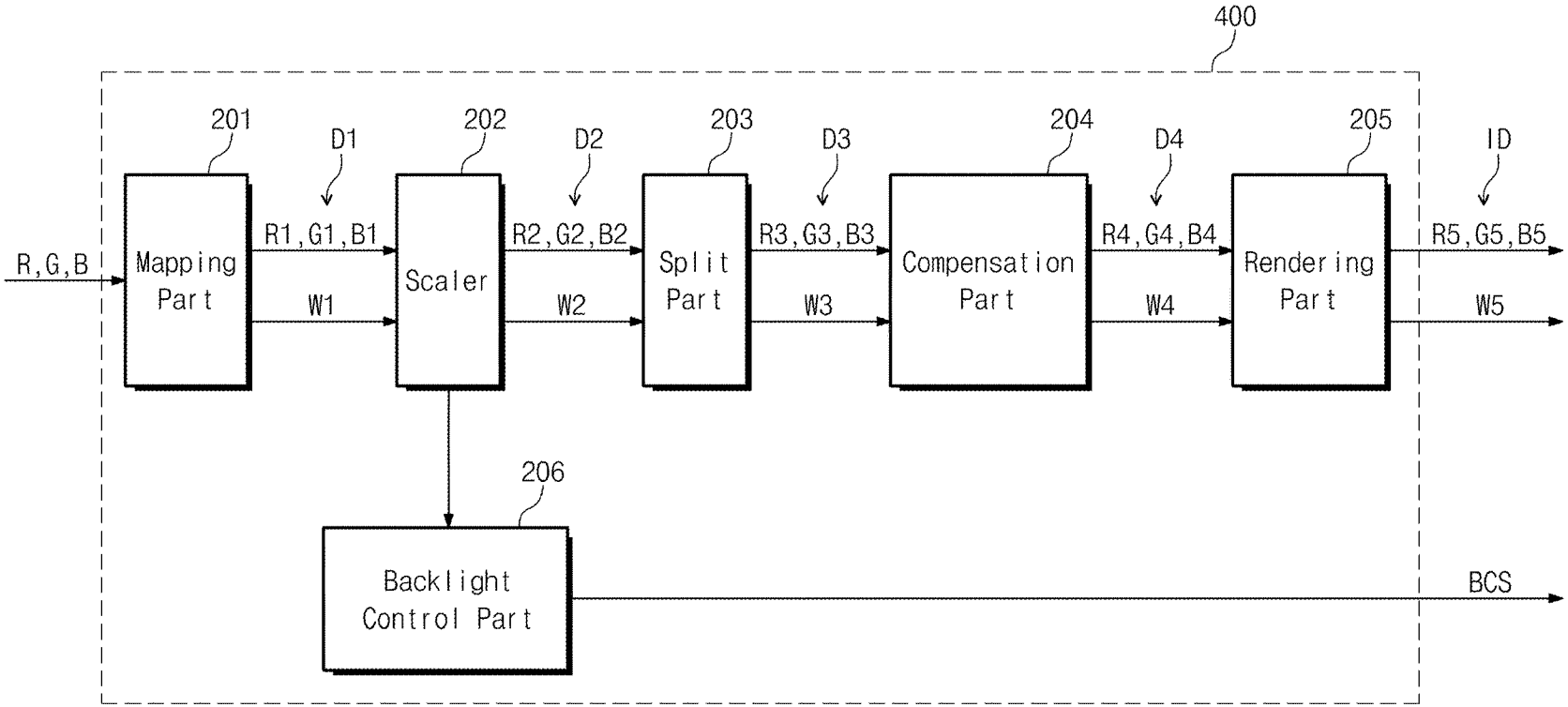
FIG. 2A is a block diagram illustrating a controller according to an exemplary embodiment of the present disclosure.
Figure 2B:
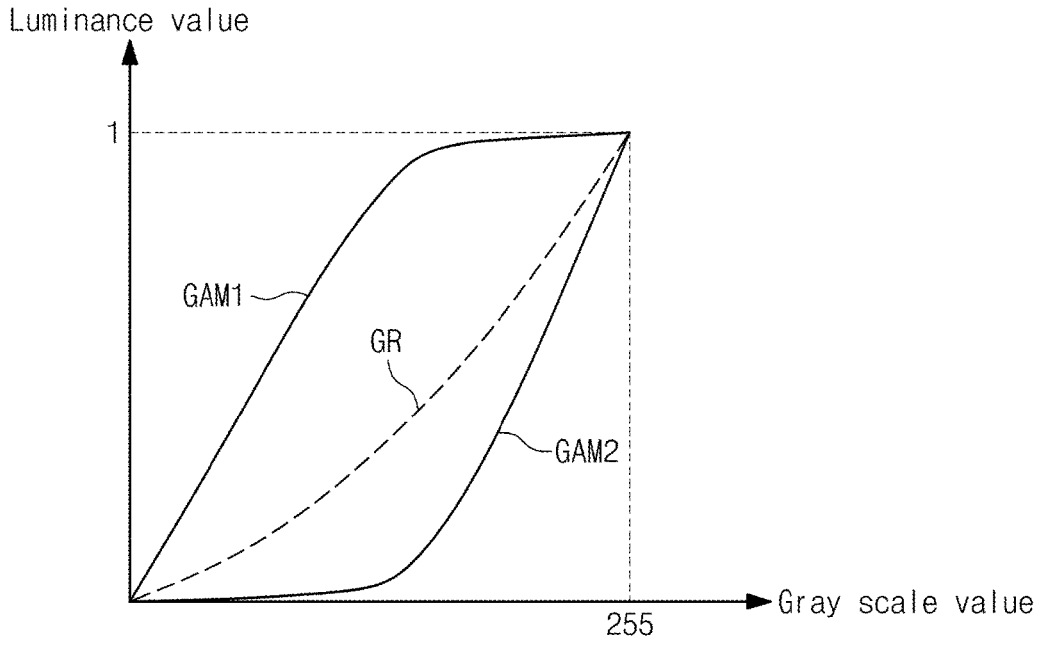
FIG. 2B is a graph illustrating a first gamma curve and a second gamma curve.
Figure 3:
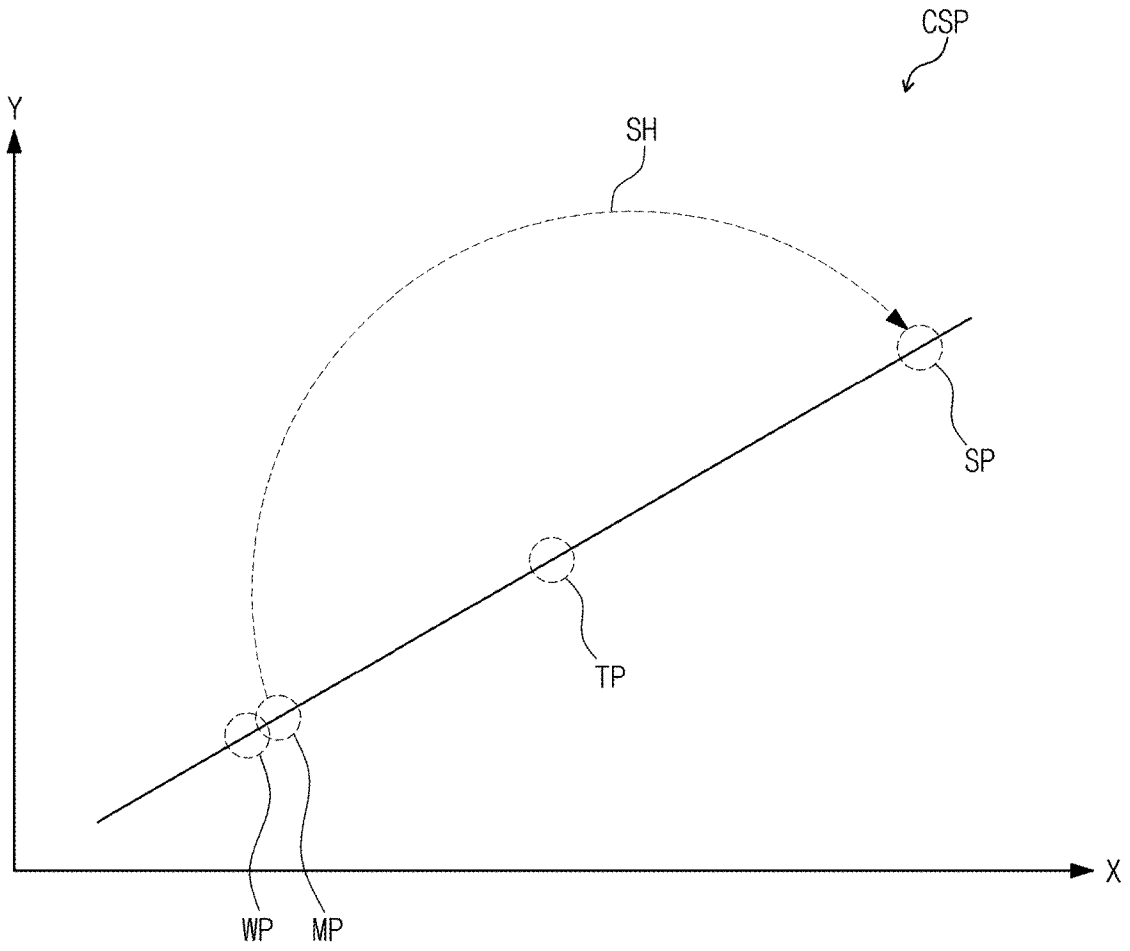
FIG. 3 is a view illustrating a compensating process of a compensating part, which is represented on a color space.
Figure 4:
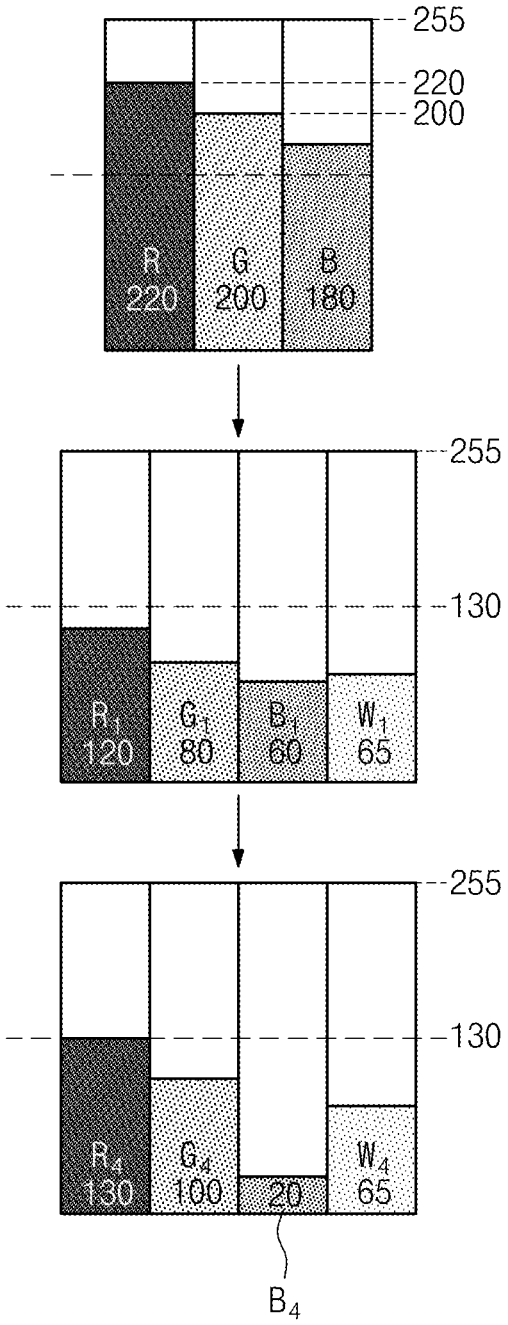
FIG. 4 is a view illustrating a compensating process of a compensating part according to an exemplary embodiment of the present disclosure.

FIG. 2A is a block diagram illustrating the controller 400 according to an exemplary embodiment of the present disclosure; FIG. 2B is a graph illustrating a first gamma curve and a second gamma curve; FIG. 3 is a view illustrating a compensating process of a compensating part, which is represented on a color space; and FIG. 4 is a view illustrating a compensating process of a compensating part.

Referring to FIGS. 2A and 2B, the controller 400 may include a mapping part (e.g., a mapper) 201, a scaler 202, a backlight control part (e.g., a backlight controller) 206, a split part (e.g., a splitter) 203, a compensation part (e.g., a compensator) 204, and a rendering part (e.g., a renderer) 205.

The mapping part 201 maps primary color data R, G, and B including information on three primary colors to generate mapping data D1. In an exemplary embodiment of the present disclosure, the three primary colors may include red, green, and blue colors.

The mapping part 201 may map RGB color gamut of the primary color data R, G, and B to RGBW color gamut using a gamut mapping algorithm (GMA) to generate the mapping data D1. The mapping data D1 may include mapping primary data R1, G1, and B1 including red, green and blue information and mapping white data W1 including white information.

The mapping data D1 may be provided to the scaler 202.

The scaler 202 may receive the mapping data D1 to generate scalar data D2.

The scalar data D2 may include scalar primary data R2, G2, and B2 and scalar white data W2.

The scaler 202 may prevent or substantially prevent a color gamut of the mapping primary data R1, G1, and B1 from dropping out due to the mapping white data W1. The scaler 202 may scale a grayscale value of the mapping data D1 and control a luminance of the backlight unit 500 in order to prevent or substantially prevent the grayscale value of the mapping data D1 from having an undesirable value (e.g., a value outside of a predefined range). In particular, the scaler 202 may receive the mapping data D1 to analyze a weight of saturated color included in an image of a present frame using a histogram and calculate a scaling value SC based on the result of the analysis.

The scaler 202 compensates for the mapping primary data R1, G1, and B1 and the mapping white data W1 based on the scaling value SC to respectively generate scalar primary data R2, G2, and B2 and scalar white data W2. The scaler 202 may output the scaling value SC to the backlight control part 206.

For example, when the weight of the saturated color, for example, yellow, in the present frame is high, the scaler 202 may scale down the grayscale values of the mapping data D1 in accordance with the scaling value SC to generate the scalar data D2. In addition, the backlight controller 206 may scale up the luminance of the light generated by the backlight unit 500 in accordance with the scaling value SC.

The scalar data D2 may be provided to the split part 203.

The split part 203 may receive the scalar data D2 to generate split data D3.

The split data D3 may include split primary data R3, G3, and B3 and split white data W3.

The split part 203 may convert the scalar primary data R2, G2, and B2 to the split primary data R3, G3, and B3 based on a first gamma curve GAM1 shown in FIG. 2B to provide the split primary data R3, G3, and B3 to the compensation part 204.

The split part 203 may convert the scalar white data W2 to the split white data W3 based on a second gamma curve GAM2 shown in FIG. 2B to provide the split white data W3 to the compensation part 204.

The first gamma curve GAM1 and the second gamma curve GAM2 may be different from each other.

Referring to FIG. 2B, the first gamma curve GAM1 may have a luminance value higher than a reference gamma curve GR at the same grayscale value, and the second gamma curve GAM2 may have a luminance value lower than the reference gamma value GR at the same grayscale value. The reference gamma curve may have a gamma value of about 2.2, the first gamma curve GAM1 may have a gamma value less than about 2.2, and the second gamma curve GAM2 may have a gamma value greater than about 2.2. As an example, the gamma value of the first gamma curve GAM1 may be about 1.5 and the gamma value of the second gamma curve GAM2 may be about 3.0.

Each of the first gamma curve GAM1, the second gamma curve GAM2, and the reference gamma value GR may be represented by a graph where an X axis denotes the grayscale value and a Y axis denotes the luminance.

The first gamma curve GAM1 has the luminance value higher than that of the reference gamma curve GR at the same grayscale value except for the case where the grayscale value is zero (0) or 255.

On the contrary, the second gamma curve GAM2 has the luminance value lower than that of the reference gamma curve GR at the same grayscale value, except for the case where the grayscale value is zero (0) or 255.

The compensation part 204 may compensate for the split data D3 to generate compensation data D4.

The compensation data D4 may include compensated primary data R4, G4, and B4 obtained by compensating for the split primary data R3, G3, and B3 and compensated white data W4 obtained by compensating for the split white data W3.

According to the present exemplary embodiment of the present disclosure, because the split white data W3 are data for a single pixel, a color coordinate of the split white data W3 may be represented by a point on a color space. Thus, the color coordinate of the split white data W3 may not be controlled.

Accordingly, the split white data W3 may be the same or substantially the same as compensated white data W4.

Referring to FIGS. 2A and 3, the compensation part 204 may compensate for the split primary data R3, G3, and B3 based on a target color coordinate TP and a primary color coordinate MP, which corresponds to a color coordinate of the split primary data R3, G3, and B3, to generate the compensated primary data R4, G4, and B4.

In the present exemplary embodiment of the present disclosure, the aforementioned or after-mentioned color coordinates may be color coordinates on an XYZ color space CSP. The XYZ color space CSP may be, but not limited to, a color space of a CIE coordinate system.

Color coordinates of the XYZ color space CSP may be obtained by a linear transformation from an RGB color coordinate.

As an example, values of the XYZ color space CSP and the RGB color space may be interconverted by the following Equation 1.

$$\begin{bmatrix} X \\ Y \\ Z \end{bmatrix} = \frac{1}{0.17697} \begin{bmatrix} 0.49 & 0.31 & 0.20 \\ 0.17697 & 0.81240 & 0.01063 \\ 0.00 & 0.01 & 0.99 \end{bmatrix} \begin{bmatrix} R \\ G \\ B \end{bmatrix}. \quad \text{Equation 1}$$

In the present exemplary embodiment of the present disclosure, the target color coordinate TP may be a color coordinate with respect to a particular image displayed through one pixel. For example, the target color coordinate may be a color coordinate newly defined on the XYZ color space in order to improve a color shift phenomenon caused by a divisional driving.

Referring to FIG. 3, the compensation part 204 may calculate a shifting color coordinate SP obtained by shifting the primary color coordinate MP to a certain direction on the XYZ color space CSP based on the target color coordinate TP and the white color coordinate WP of the split white data W3. The compensation part 204 may compensate for the split primary data R3, G3, and B3 based on the shifting color coordinate SP to generate the compensated primary data R4, G4, and B4.

For example, the compensation part 204 may calculate a primary luminance value of the split primary data R3, G3, and B3 and a white luminance value of the white split data W4.

The compensation part 204 may calculate a primary beta value based on the primary luminance value and the white luminance value and calculate a white beta value based on the white luminance value and the primary luminance value.

The primary beta value and the white luminance value may be constants used in an equation of calculating the shifting color coordinate SP.

When the primary beta value, the white beta value, the primary luminance value, and the white luminance value are respectively referred to as MB, WB, ML, and WL, the primary luminance value, the white luminance value, the primary beta value, and the white beta value may satisfy the following Equation 2 and Equation 3.

$$MB = \frac{ML}{ML + WL} \quad \text{Equation 2}$$

$$WB = \frac{WL}{ML + WL} \quad \text{Equation 3}$$

In other words, the primary beta value may be a ratio of the primary luminance value to a value of a sum of the primary luminance value and the white luminance value. The white beta value may be a ratio of the white luminance value to a value of a sum of the primary luminance value and the white luminance value.

When an x coordinate of the shifting color coordinate, a y coordinate of the shifting color coordinate, a z coordinate of the shifting color coordinate, an x coordinate of the target color coordinate, a y coordinate of the target color coordinate, a z coordinate of the target color coordinate, an x coordinate of the white color coordinate, a y coordinate of the white color coordinate, and a z coordinate of the white color coordinate are respectively referred to as SX, SY, SZ, TX, TY, TZ, WX, WY, and WZ, the target color coordinate TP, the shifting color coordinate SP, and the white color coordinate WP may satisfy the following Equation 4.

$$\begin{pmatrix} SX \\ SY \\ SZ \end{pmatrix} = \begin{pmatrix} TX - WB \cdot WX \\ TY - WB \cdot WY \\ TZ - WB \cdot WZ \end{pmatrix} \cdot \frac{1}{MB} \quad \text{Equation 4}$$

By using the Equation 4, the compensation part 204 may generate the shifting color coordinate SP. In addition, the compensation part 204 may generate the compensated primary data R4, G4, and B4 by XYZ-to-RGB converting the shifting color coordinate SP.

As a result, the compensation part 204 compensates for the split primary data R3, G3, and B3 to generate the compensated primary data R4, G4, and B4.

The compensation part 204 receives the split primary data R3, G3, and B3 through the above-mentioned calculating process and performs the gamma compensating process on the split primary data R3, G3*m* and B3 to generate the compensated primary data R4, G4, and B4, and thus the color shifting phenomenon of the displayed image, which is caused by the primary logic pixels MPX and the white logic pixels WPX receiving data voltages based on different gamma curves, may be improved.

The rendering part 205 may receive the compensated primary data R4, G4, and B4 and the compensated white data W4 to generate the image data ID.

The image data ID may include rendered primary data R5, G5, and B5 and rendered white data W5. As an example, the rendering part 205 may receive the compensated primary data R4, G4, and B4 to generate the rendered primary data R5, G5, and B5 through a sub-pixel rendering operation, and may receive the compensated white data W4 to generate the rendered white data W5.

The sub-pixel rendering operation may include a re-sample filtering operation and a sharp filtering operation.

The re-sample filtering operation may transform data of the compensated primary data R4, G4, and B4 and the compensated white data W4 corresponding to a target pixel based on data corresponding to the target pixel and pixels adjacent to the target pixel.

The target pixel may be one pixel of the primary logic pixels MPX of the display panel DP or one pixel of the white logic pixels WPX of the display panel DP.

The sharp filtering operation may determine a shape and a position of a line, an edge, a spot, and a diagonal line of the image on the basis of the compensated primary data R4, G4, and B4 and the compensated white data W4 to compensate for the compensated primary data R4, G4, and B4 and the white compensated white data W4 based on the determined data.

An input gamma conversion unit (e.g., an input gamma converter) may be further provided at the front of the mapping part 201. The input gamma conversion unit adjusts and outputs gamma characteristics of the primary color data R, G, and B in order to facilitate data processing at the mapping part 201 and rendering part 205, which are following the input gamma conversion part. More particularly, the input gamma conversion unit performs linearization on the primary color data R, G, and B and outputs the linearized primary data R, G, and B to allow non-linear gamma characteristics of the primary color data R, G, and B to be proportional to luminance value.

Also, an output gamma conversion unit may be further provided at the rear of the rendering part 205. The output gamma conversion unit performs inverse gamma compensation on the rendered primary data R5, G5, and B5 and the rendered white data W5 to non-linearize and output the rendered primary data R5, G5, and B5 and the rendered white data W.

Hereinafter, a process in which the compensating part 204 compensates for the split primary data R3, G3, B3 to generate the compensated primary data R4, G4, and B4 will be explained in further detail.

Referring to FIG. 3, the white color coordinate WP may be a color coordinate of a first white image displayed through the white sub-pixel SP4 (e.g., shown in FIG. 1), and the primary color coordinate MP may be a color coordinate of a second white image displayed through the first to third primary sub-pixels SPX1 to SPX3. The white color pixel WP and the primary color coordinate MP may be set or predetermined through measurement.

The target color coordinate TP, which corresponds to a color coordinate of a set or predetermined white image, may be located at a center of an area corresponding to the white color on the XYZ color space CSP.

In the exemplary embodiment of the present disclosure, the white color coordinate WP and the primary color coordinate MP may be located in an area which is more yellowish than the target color coordinate TP. In other words, at least one of an x coordinate and a y coordinate of the white color coordinate WP and the primary color coordinate MP may be less than an x coordinate and a y coordinate of the target color coordinate TP.

In this case, because the compensation part 204 shifts the primary color coordinate MP to a shifting color coordinate SP in an area more bluish than the target color coordinate TP, the compensation part 204 may calculate the shifting color coordinate SP to allow a white image obtained by summing the first and second white images to have the target color coordinate TP.

As an example, referring to FIGS. 2 and 4, in the present exemplary embodiment of the present disclosure, a red grayscale value of the primary color data R, G, and B may be 220, a green grayscale value of the primary color data R, G, and B may be 200, and a blue grayscale value of the primary color data R, G, and B may be 180. A maximum value of the red, green, and blue grayscale values may be 255 and a minimum value of the red, green, and blue grayscale values may be zero (0).

The mapping part 201 may convert the primary color data R, G, and B to the mapping primary data R1, G1, and B1 (e.g., shown in FIG. 2A) and the mapping white data W1 (e.g., shown in FIG. 2A).

In the exemplary embodiment of the present disclosure, a red grayscale value of the mapping primary data R1, G1, and B1 may be 120, a green grayscale value of the mapping primary data R1, G1, and B1 may be 80, and a blue grayscale value of the mapping primary data R1, G1, and B1 may be 60. Also, a grayscale value of the mapping white data W1 generated by the mapping part 201 may be 65.

A maximum value of the grayscale value of the mapping white data W1 also may be 255 and a minimum value of the grayscale value of the mapping white data W1 also may be zero (0).

Each of the red, green and blue grayscale values of the mapping primary data R1, G1, and B1 may be less than that of the red, green, and blue grayscale values of the primary color data R, G, and B. This is because the mapping part 201 newly generates the mapping white data W1, and at least a portion of the grayscale value of each of the primary color data R, G, and B is distributed and displayed through the mapping white data W1.

As aforementioned, the mapping primary data R1, G1, and B1 may be converted to the split primary data R3, G3, and B3, and the split primary data R3, G3, and B3 may be converted to the compensated primary data R4, G4, and B4 by the compensation part 204.

As shown in FIG. 4, red, green, and blue gray scale values of the compensated primary data R4, G4, and B4 may be 130, 100 and 20, respectively.

In other words, the compensation part 204 adds 10 to the red grayscale value of the mapping primary data R1, G1, and B1, adds 20 to the green grayscale value of the mapping primary data R1, G1, and B1, and subtracts 40 from the blue grayscale value of the mapping primary data R1, G1, and B1 to generate the compensated primary data R4, G4, and B4.

In addition, the grayscale value of the mapping white data W1 may be maintained at 65 as described in FIG. 2.

Through the above-described process, the color coordinate corresponding to the compensated primary data R4, G4, and B4 may be the shifting color coordinate SP. That is, the compensated primary data R4, G4, and B4 may be bluish image data. A color coordinate on the color space, which corresponds to an image data obtained by summing the compensated primary data R4, G4, and B4 and the compensated white data W4 of yellowish image data, may be the target color coordinate TP.

Referring to FIG. 3, the XYZ color space CSP may be defined by an X axis and a Y axis. FIG. 3 illustrates the white color coordinate WP, the primary color coordinate MP, the shifting color coordinate SP, and the target color coordinate TP on the XYZ color space CSP.

As described above, the white color coordinate WP may not be shifted, and the primary color coordinate MP may be shifted to the shifting color coordinate SP. As an example, the primary color coordinate MP may move in an X-axis direction and a Y-axis direction on the XYZ color space CSP, and then shifted to the shifting color coordinate SP.

In addition, the shifting color coordinate SP and the white color coordinate WP on the XYZ color space CPS may be summed to each other to become same as the target color coordinate.

Thus, the compensation part 204 may shift the primary color coordinate MP through Equations 2 to 4 to calculate the shifting color coordinate SP. A process of calculating the shifting color coordinate SP may be performed by using the target color coordinate TP, which has been set or predetermined, and the white color coordinate.

Figure 5A:
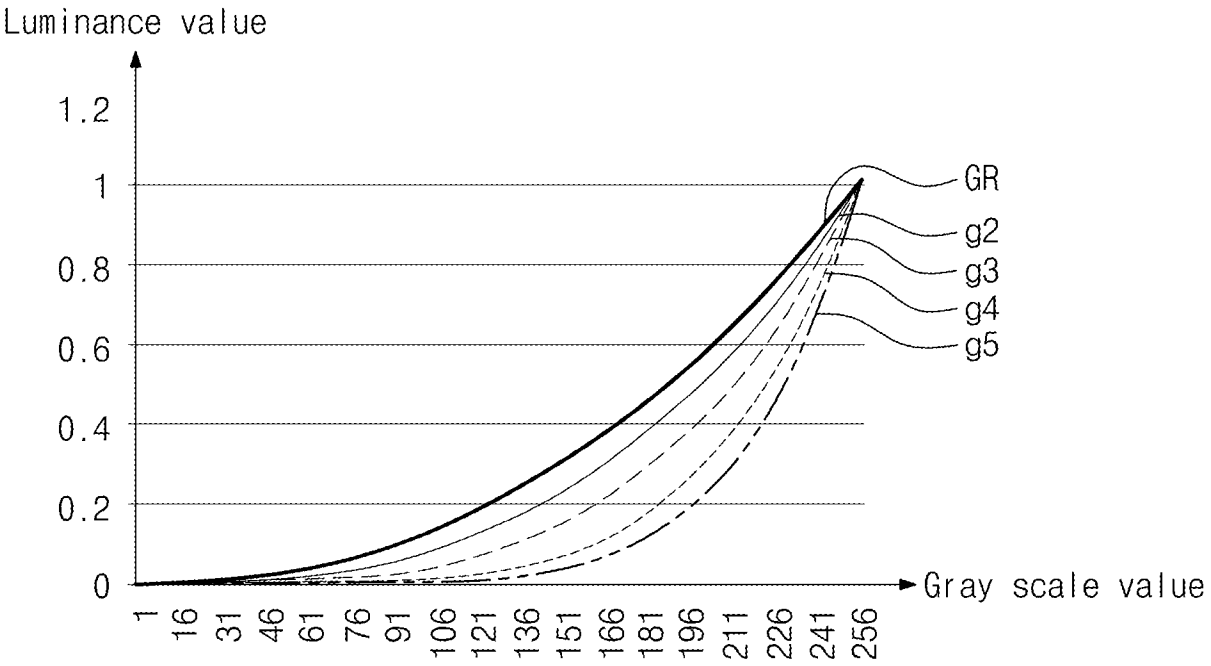
Figure 5C:
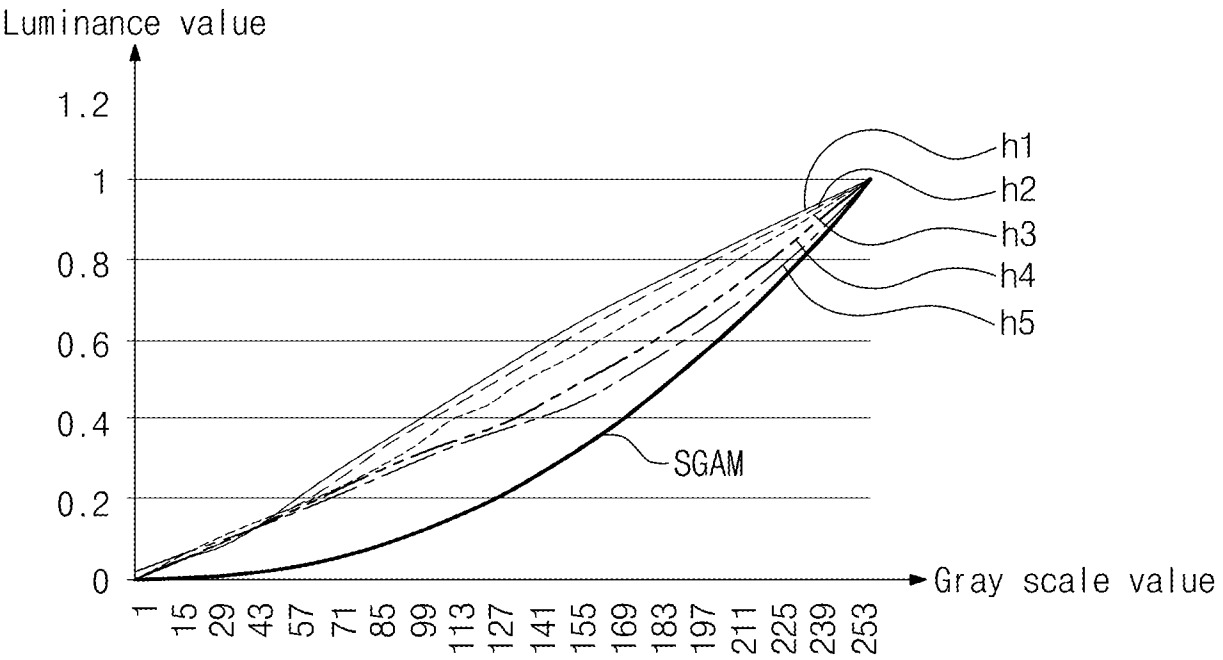

FIGS. 5A to 5C illustrate an effect obtained by driving a display apparatus according to an exemplary embodiment of the present disclosure.

FIG. 5A illustrates several examples of the gamma curve for one white sub-pixel among the white sub-pixels SPX4 (e.g., shown in FIG. 1).

Referring to FIG. 5A, GR denotes the reference gamma curve GR. a gamma curve g2 denotes a gamma curve having a gamma value of about 2.69 higher than about 2.2 that is a reference gamma value of the reference gamma curve GR. In addition, a gamma curve g3 having a gamma value of about 3.46 that is higher than the gamma value of the gamma curve g2, a gamma curve g4 having a gamma value of about 4.84 that is higher than the gamma value of the gamma curve g3, and a gamma curve g5 having a gamma value of about 6.05 that is higher than the gamma value of the gamma curve g4 are sequentially illustrated in FIG. 5A.

In FIG. 5A, an X axis denotes a grayscale value and a Y axis denotes a luminance value according to the grayscale value of the X axis.

Referring to FIG. 5A, the luminance value of the gamma curve may decrease at the same grayscale value as the gamma value of the gamma curve increases. For example, the gamma curve g2 may have the luminance value lower than that of the reference gamma curve GR at the same grayscale value, the gamma curve g3 may have the luminance value lower than that of the gamma curve g2 at the same grayscale value, the gamma curve g4 may have the luminance value lower than that of the gamma curve g3 at the same grayscale value, and the gamma curve g5 may have the luminance value lower than that of the gamma curve g4 at the same grayscale value.

In the present exemplary embodiment of the present disclosure, the second gamma curve GAM2 (e.g., shown in FIG. 2B) may be, but not limited to, one gamma curve among the gamma curves g2 to g5. In other words, the second gamma curve GAM2 may convert the scalar white data W2 (e.g., shown in FIG. 2A) to the split white data W3 (e.g., shown in FIG. 2A) based on the gamma curves having the gamma value higher than that of the reference gamma curve GR.

Referring to FIG. 5B, a wash-out index denoting a wash-out occurring in the display panel may decrease as the gamma value of the second gamma curve GAM2 (e.g., shown in FIG. 2B) gradually increases. The term "wash-out" used herein refers to a phenomenon where an image displayed by a display panel becomes blurred.

As an example, in the case that the gamma value of the second gamma curve GAM2 (e.g., shown in FIG. 2B) is about 2.2, the wash-out index is about 15.27, however, in the case that the gamma value of the second gamma curve (e.g., shown in FIG. 2B) is about 6.05, the wash-out index may be about 11.34. However, values shown in FIG. 5B show the tendency of the wash-out index other than absolute index values according to the gamma value of the gamma curve, and the values may be changed. As the value of the wash-out index decreases, the wash-out phenomenon is improved.

Consequently, referring to FIGS. 2A and 2B, according to the exemplary embodiment of the present disclosure, by a divisional driving method where the split part 203 converts the scalar primary data R2, G2, and B2 to the split primary data R3, G3, and B3 based on the gamma curve GAM1, the split part 203 converts the scalar white data W2 to the split white data W3 based on the second gamma curve GAM2, and by increasing the gamma value of the second gamma curve GAM2, the wash-out phenomenon is improved (e.g., reduced).

FIG. 5C illustrates a front or side gamma curve of one white sub-pixel among the white sub-pixels.

FIG. 5C shows a front gamma curve SGAM when the image is viewed from a front surface (e.g., in the case that the gamma value is about 2.2), a side gamma curve h1 when the gamma value is about 2.2, a side gamma curve h2 when the gamma value is about 2.69, a side gamma curve h3 when the gamma value is about 3.46, a side gamma curve h4 when the gamma value is about 4.84, and a side gamma curve h5 when the gamma value is about 6.05.

In FIG. 5C, an X axis denotes the grayscale value, and a Y axis denotes the luminance value as a function of the grayscale value of the X axis.

Referring to FIG. 5C, the side gamma curve obtained when the image is viewed from a side surface may be close to the front gamma curve SGAM as the gamma value of the side gamma curve increases. As an example, the side gamma curve h2 is formed to be closer to the front gamma curve SGAM than the side gamma curve h1, the side gamma curve h3 is formed to be closer to the front gamma curve SGAM than the side gamma curve h2, the side gamma curve h4 is formed to be closer to the front gamma curve SGAM than the side gamma curve h3, and the side gamma curve h5 is formed to be closer to the front gamma curve SGAM than the side gamma curve h4.

As a result, referring to FIGS. 2A and 2B, the controller 400 according to the present exemplary embodiment of the present disclosure adopts a divisional driving method where the split primary data R3, G3, and B4 are generated based on the first gamma curve GAM1, the split white data W4 are generated based on the second gamma curve GAM2, and the gamma value of the second gamma curve GAM2 increases. Accordingly, the wash-out phenomenon occurring in the display panel DP, which caused by the white sub-pixel may be improved, and a difference in visibility between a front image and a side image may be reduced.

In addition, the color shifting phenomenon may occur on the image displayed through the display panel DP due to the divisional driving method. In this case, the color shifting phenomenon may be improved by generating the compensated primary data R4, G4, and B4 using the compensation part 204 as described above.

Figure 5D:
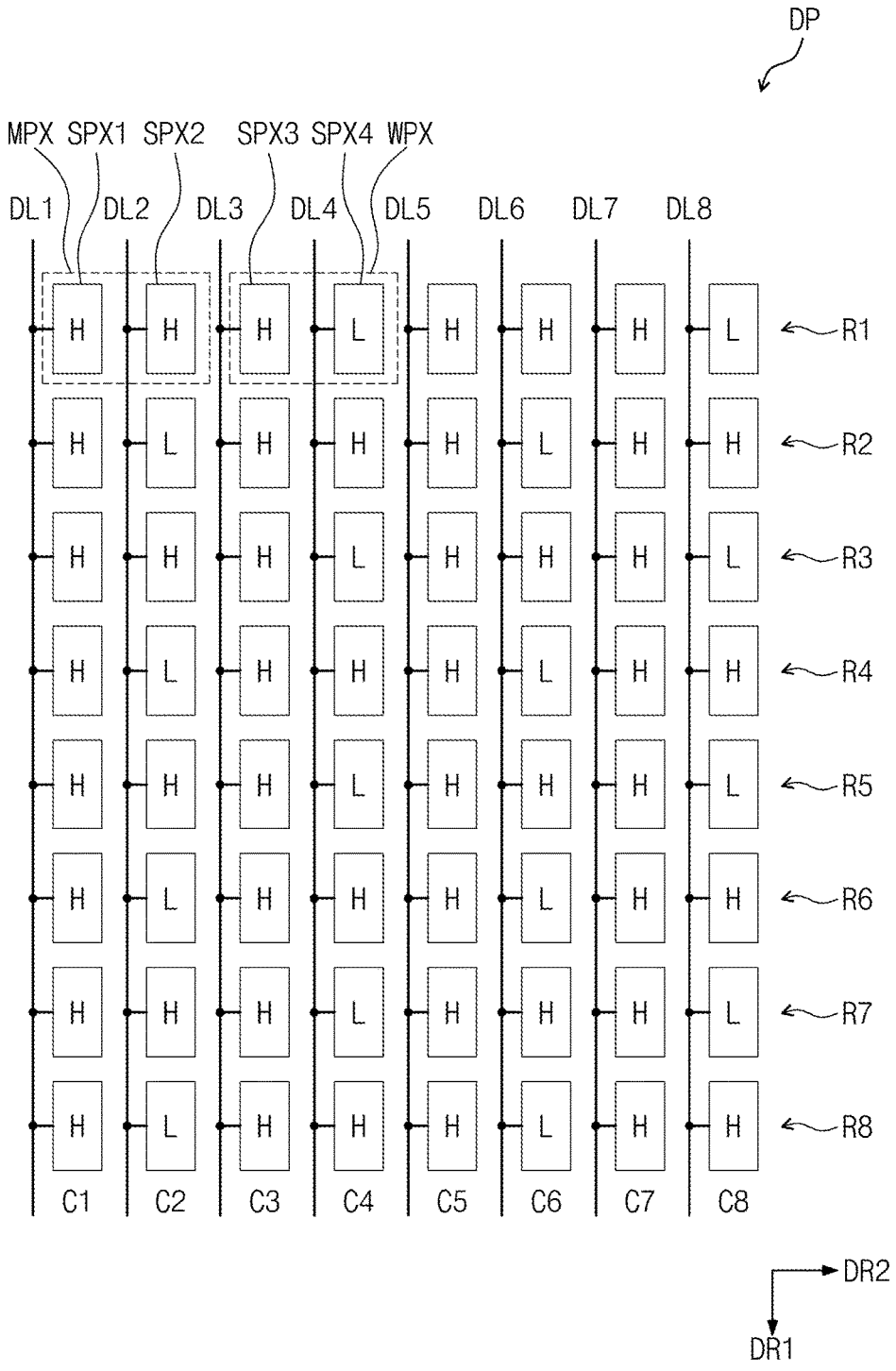
FIG. 5D is a block diagram illustrating a display apparatus according to an exemplary embodiment of the present disclosure.

FIG. 5D illustrates a display apparatus according to an exemplary embodiment of the present disclosure. FIG. 5D is a plane view showing a display panel DP driven by the space divisional driving method.

Hereinafter, the space divisional driving method will be described in further detail.

Referring to FIG. 5D, the display panel DP may include the primary logic pixels MPX and the white logic pixels WPX, which are connected to first to eighth data lines DL1 to DL8.

As illustrated in FIG. 5D, the first primary sub-pixel SPX1 may display the red, the second primary sub-pixel SPX2 may display the green, and the third primary sub-pixel SPX3 may display the blue. However, the colors displayed by the first to third primary sub-pixels SPX1 to SPX3 should not be limited thereto or thereby. For example, the first to third primary sub-pixels SPX1 to SPX3 may respectively display yellow, cyan, and magenta.

The primary logic pixels MPX and the white logic pixels WPX may be arranged in a matrix form along a first direction DR1 and a second direction DR2.

A set of the sub-pixels sequentially arranged along the first direction DR1 among the sub-pixels SPX1 to SPX4 may be referred to as a pixel row and a set of the sub-pixels sequentially arranged along the second direction DR2, which is substantially vertical to the first direction DR1, among the sub-pixels SPX1 to SPX4 may be referred to as a pixel column.

The display panel DP may include a plurality of pixel rows and a plurality of pixel columns. In FIG. 5D, eight pixel rows and eight pixel columns of the display panel DP are shown.

Each of the primary logic pixels MPX may be disposed adjacent to the white logic pixels WPX. In further detail, the primary logic pixels MPX may be alternately arranged with the white logic pixels WPX.

Referring to FIGS. 2B and 5D, the first to third primary sub-pixels SPX1 to SPX3 may be driven based on the first gamma curve GAM1, and the white sub-pixel SPX4 may be driven based on the second gamma curve GAM2. For example, the first to third primary sub-pixels SPX1 to SPX3 may receive a relatively high grayscale voltage H based on the first gamma curve GAM1, and the white sub-pixels SPX4 may receive a relatively low grayscale voltage L based on the second gamma curve GAM2.

Figure 6A:
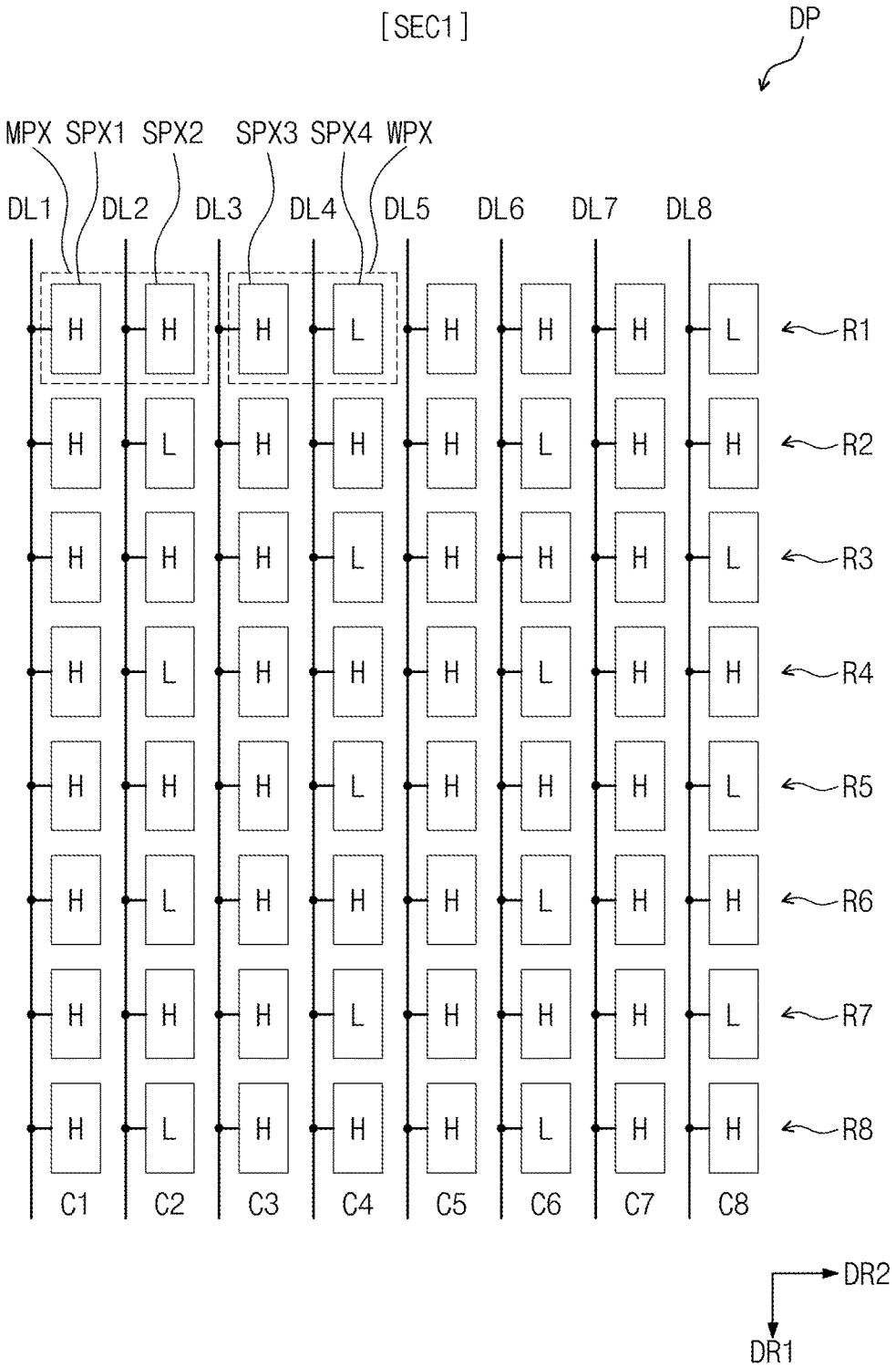
FIGS. 6A-6B are block diagrams illustrating a display apparatus according to another exemplary embodiment of the present disclosure.

That is, referring to FIGS. 2A, 2B, and 6A, the split part 204 converts the mapping primary data R1, G1, and B1 to the split primary data R3, G3, and B3 based on the first gamma curve GAM1, and thus the first to third primary sub-pixels SPX1 to SPX3 may receive the high grayscale voltage H. In addition, as the split part 204 converts the mapping white data W1 to the split white data W3 based on the second gamma curve GAM2, the white sub-pixel SPX4 may receive the low grayscale voltage L.

Figure 6B:
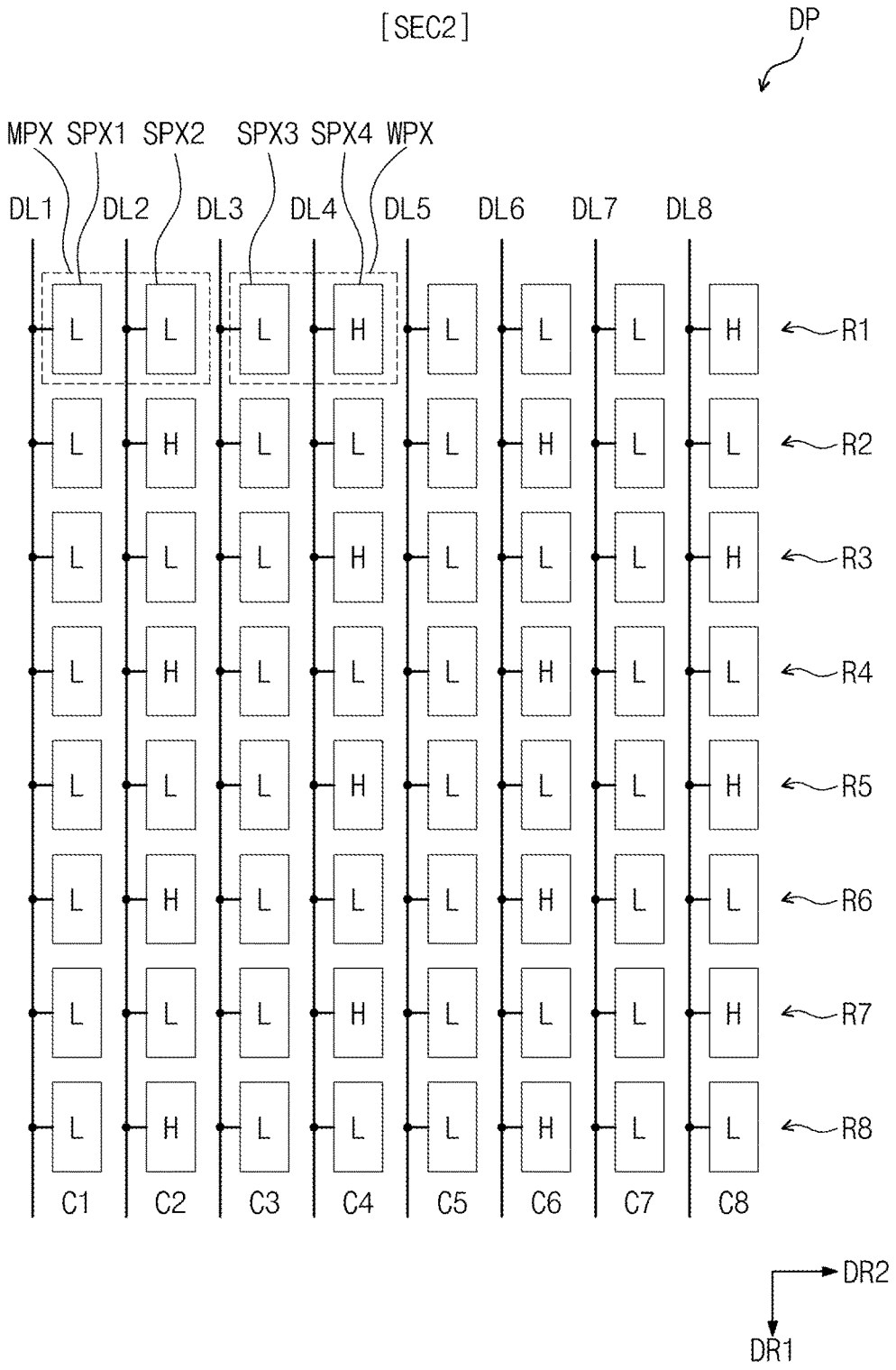

FIGS. 6A and 6B are views illustrating a display apparatus according to another exemplary embodiment of the present disclosure.

In the present exemplary embodiment, detailed descriptions of a display panel DP shown in FIGS. 6A and 6B may be omitted as the display panel DP shown in FIGS. 6A and 6B has the same or substantially the same structure and function as those of the display panel DP shown in FIG. 5D.

Even though only the space divisional driving scheme is explained for the driving of the pixels of the display panel DP throughout FIGS. 1 to 5D, the above-mentioned embodiments according to the present disclosure may also be applied to a display panel driven in a time divisional driving scheme.

Hereinafter, a first period SEC1 and a second period SEC2 will be referred to explain the time divisional driving scheme of the display panel DP.

The second period SEC2 may be a period temporally succeeding the first period SEC1.

Each of the first period SEC1 and the second period SEC2 corresponds to at least "n" frame(s), where "n" is a natural number. Thus, the first period SEC1 may be a period corresponding to a first frame, and the second period SEC2 may be a period corresponding to a second frame.

Hereinafter, only the first period SEC1 and the second period SEC2 will be described in further detail, however, the following embodiment of the present disclosure should not be limited thereto or thereby. That is, periods temporally succeeding the second period SEC2 and corresponding to "n" frame(s) may be also defined.

As an example, referring to FIGS. 6A and 6B, the first to third primary sub-pixels SPX1 to SPX3 may be driven based on the first gamma curve GAM1, and the white sub-pixel SPX4 may be driven based on the second gamma curve GAM2 during the first period SEC1. For example, the first to third primary sub-pixels SPX1 to SPX3 may receive the high grayscale voltage H based on the first gamma curve GAM1, and the white sub-pixel SPX4 may receive the low grayscale voltage L based on the second gamma curve GAM2.

In other words, referring to FIGS. 2A, 2B, and 6A, the split part 204 converts the mapping primary data R1, G1, and B1 to the split primary data R3, G3, and B3 based on the first gamma curve GAM1, and thus the first to third primary sub-pixels SPX1 to SPX3 may receive the high grayscale voltage H during the first period SEC1. In addition, because the split part 204 converts the mapping white data W1 to the split white data W3 based on the second gamma curve GAM2, the white sub-pixel SPX4 may receive the low grayscale voltage L during the first period SEC1.

The first to third primary sub-pixels SPX1 to SPX3 may be driven based on the second gamma curve GAM2 during the second period SEC2, and the white sub-pixel SPX4 may be driven based on the first gamma curve GAM1 during the second period SEC2. For example, the first to third primary sub-pixels SPX1 to SPX3 may receive the low grayscale voltage L based on the second gamma curve GAM2, and the white sub-pixel SPX4 may receive the high grayscale voltage H based on the second gamma curve GAM1.

In other words, referring to FIGS. 2A, 2B, and 6B, as the split part 204 converts the mapping primary data R1, G1, and B1 to the split primary data R3, G3, and B3 based on the second gamma curve GAM2, the first to third primary sub-pixels SPX1 to SPX3 may receive the low grayscale voltage L during the second period SEC1. In addition, because the split part 204 converts the mapping white data W1 to the split white data W3 based on the first gamma curve GAM1, the white sub-pixel SPX4 may receive the high grayscale voltage H during the second period SEC2.

Remaining driving processes will be omitted because they are same or substantially the same as the above-mentioned processes.

In the same manner as the spatial divisional driving scheme, the wash-out phenomenon occurring in the image displayed through the display panel DP (e.g., shown FIG. 1) may be improved (e.g., reduced) by employing the time divisional driving scheme, and the difference in visibility between the front and side images may be reduced.

Figure 7:
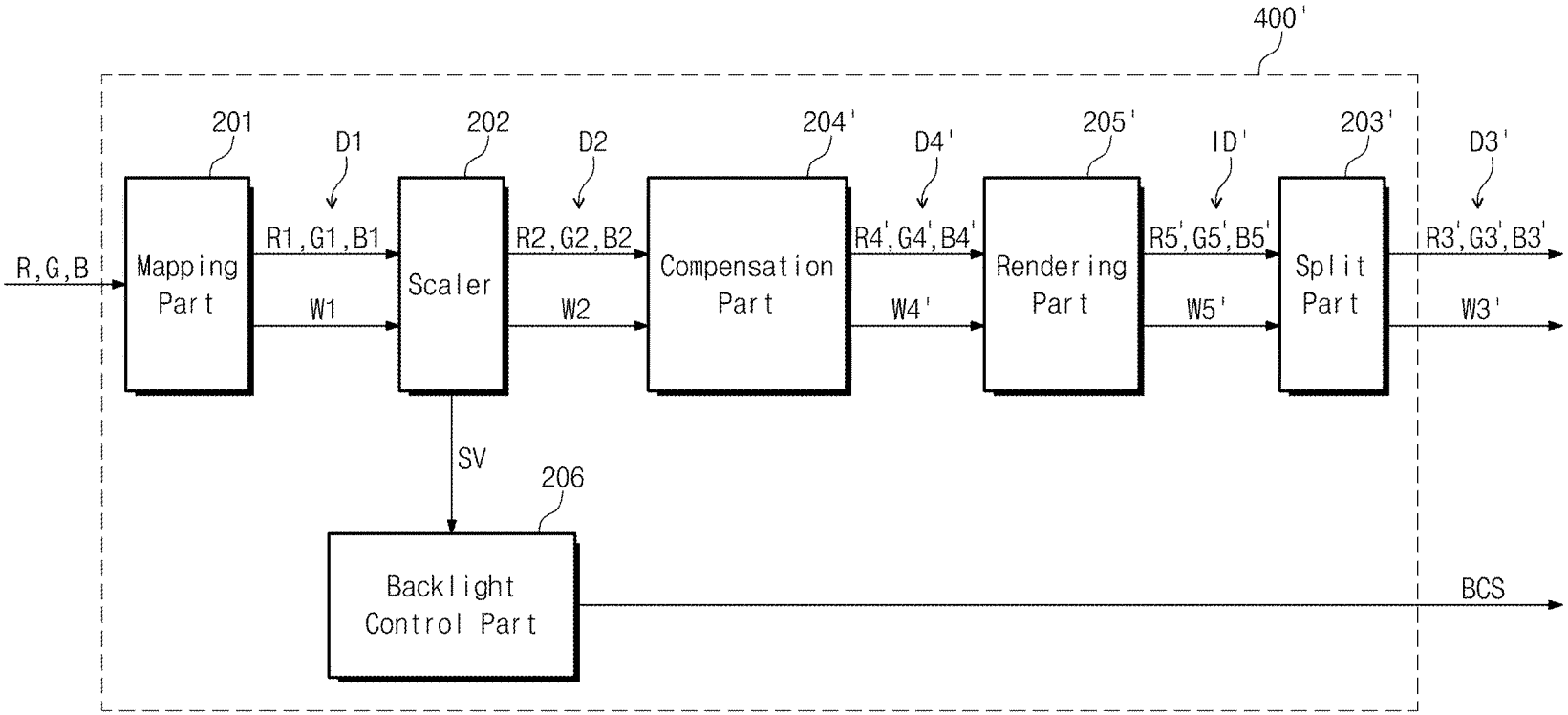
FIG. 7 is a block diagram illustrating a controller according to another exemplary embodiment of the present disclosure.

FIG. 7 is a block diagram illustrating a controller 400' according to another exemplary embodiment of the present disclosure The controller 400' shown in FIG. 7 has the same or substantially the same structure and function of those of the controller 400 shown in FIG. 2A except for a split part (e.g., a splitter) 203' shown in FIG. 7.

Therefore, in the following, features that are different between the controller 400' shown in FIG. 7 and the controller 400 shown in FIG. 2A will be primarily explained, and detailed descriptions of the same elements as those in FIG. 2 may be omitted in order to avoid redundancy.

Referring to FIGS. 2A, 2B, and 7, a compensation part (e.g., a compensator) 204' may compensate for the scalar primary data R2, G2, and B2 based on the target color coordinate TP (e.g., shown in FIG. 3) and the color coordinate of the scalar primary data R2, G2, and B2 to generate the compensated primary data R4, G4, and B4.

The compensation part 204' may calculate a color coordinate obtained by shifting the color coordinate of the scalar primary data R2, G2, and B2 to a certain direction on the XYZ color space CSP (e.g., shown in FIG. 3) based on the target color coordinate TP (e.g., shown in FIG. 3) and the white color coordinate of the split white data W3. The compensation part 204' compensates for the scalar primary data R2, G2, and B2 based on the shifted color coordinate to generate the compensated primary data R4', G4', and B4'.

For example, the compensation part 204' may calculate a luminance value of the scalar primary data R2, G2, and B2 and a luminance value of the white scalar data W2.

The compensation part 204' may calculate first and second beta values based on the luminance value of the scalar primary data R2, G2, and B2 and the luminance value of the scalar white data W2.

The first and second beta values may be constants used in an equation that calculates the shifted color coordinate.

When the first beta value, the white beta value, the luminance value of the scalar primary data R2, G2, and B2, and the luminance value of the scalar white data W2 are respectively referred to as BT1, BT2, L1, and L2, the luminance value L1 of the scalar primary data R2, G2, and B2, the luminance value L2 of the scalar white data W2, the first beta value BT1, and the second beta value BT2 may satisfy the following Equations 5 and 6.

$$BT1 = \frac{L1}{L1 + L2} \quad \text{Equation 5}$$

$$BT2 = \frac{L2}{L1 + L2} \quad \text{Equation 6}$$

In other words, the first beta value may be a ratio of the luminance value of the scalar primary data R2, G2, and B2 to a value obtained by summing the luminance value of the scalar primary data R2, G2, and B2 and the luminance value of the scalar white data W2. The second beta value may be a ratio of the luminance value of the scalar white data W2 to a value obtained by summing the luminance value of the scalar primary data R2, G2, and B2 and the luminance value of the scalar white data W2.

When an x coordinate of the shifted color coordinate, a y coordinate of the shifted color coordinate, a z coordinate of the shifted color coordinate, an x coordinate of the target color coordinate, a y coordinate of the target color coordinate, a z coordinate of the target color coordinate, an x coordinate of the scalar white data W2, a y coordinate of the scalar white data W2, and a z coordinate of the scalar white data W2 are respectively referred to as S1, S2, S3, TX, TY, TZ, WT1, WT2, and WT3, the target color coordinate TP, the shifted color coordinate, and color coordinate of the scalar white data W2 may satisfy the following Equation 7.

$$\begin{pmatrix} S1 \\ S2 \\ S3 \end{pmatrix} = \begin{pmatrix} TX - BT2 \cdot WT1 \\ TY - BT2 \cdot WT2 \\ TZ - BT2 \cdot WT3 \end{pmatrix} \cdot \frac{1}{BT1} \quad \text{Equation 7}$$

The compensation part 204' may generate the shifted color coordinate by using Equation 7. In addition, the compensation part 204' may generate the compensated primary data R4', G4', and B4' by XYZ-to-RGB conversion performed on the shifted color coordinate.

Consequently, the compensation part 204' may generate the compensated primary data R4', G4', and B4' by compensating for the scalar primary data R2, G2, and B2. Furthermore, the compensation part 204' may generate the compensated white data W4'.

In the present exemplary embodiment of the present disclosure, because the scalar white data W2 are data for a single pixel, the color coordinate of the scalar white data W2 may be represented as a point on the color coordinate space. Thus, the color coordinate of the scalar white data W3 may not be controlled.

Therefore, the scalar white data W2 may be substantially the same as the compensated white data W4'.

The rendering part (e.g., the renderer) 205' may sub-pixel render the compensated data D4' to generate the image data ID' through the manner described with reference to FIG. 2A.

The image data ID' may include the rendered primary data R5', G5', and B5' and the rendered white data W5'. The image data ID' may be provided to the split part 203'.

The split part 203' may receive the rendered data D5' to generate split data D3'.

The split data D3' may include split primary data R3', G3', and B3' and split white data W3'.

The split part 203' may convert the rendered primary data R5', G5', and B5' to the split primary data R3', G3', and B3' based on the first gamma curve GAM1 shown in FIG. 2B.

The split part 203' may convert the rendered white data W5' to the split white data W3 based on the second gamma curve GAM2 shown in FIG. 2B.

In addition the split data D3' of FIG. 7 may be substantially the same data as the image data ID of FIG. 2A.

Consequently, there is no substantial difference between the controller 400 of FIG. 2A and the controller 400' of FIG. 7 except for the location of the split part 203', and the controller 400 of FIG. 2A and the controller 400' of FIG. 7 may output the same data. Effects achieved by the generation of the compensated data D4', the generation of the rendering data ID by the rendering part 205', and the controller 400' are the same as those described in FIGS. 2A and 2B.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "lower", "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display apparatus and/or any other relevant devices or components, such as the controller 100, the gate driver 200, and the data driver 300, according to embodiments of the present invention described herein may be implemented utilizing any suitable hardware, firmware (e.g. an application-specific integrated circuit), software, or a suitable combination of software, firmware, and hardware. For example, the various components of the display apparatus may be formed on one integrated circuit (IC) chip or on separate IC chips. Further, the various components of the display apparatus may be implemented on a flexible printed circuit film, a tape carrier package (TCP), a printed circuit board (PCB), or formed on a same substrate. Further, the various components of the display apparatus may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. A display apparatus comprising:

a display panel comprising red, green, blue, and white sub-pixels;

a mapper configured to map a primary color data comprising information on three primary colors to generate mapping primary data comprising red, green, and blue information and mapping white data comprising white information;

a splitter configured to generate split primary data based on the mapping primary data and one gamma curve, and to generate split white data based on the mapping white data and another gamma curve different from the one gamma curve; and a compensator configured to compensate for the split primary data based on a target color coordinate and a primary color coordinate corresponding to a color coordinate of the split primary data to generate compensated primary data, wherein the primary color coordinate is a color coordinate of a white image displayed through the red, green, and blue sub-pixels, and wherein the compensator is configured to calculate a primary luminance value of the split primary data and a white luminance value of the split white data, to calculate a primary beta value and a white beta value based on the primary luminance value and the white luminance value, and to generate the compensated primary data based on the primary beta value and the white beta value.

2. The display apparatus of claim 1, wherein the compensator is configured to calculate a shifting color coordinate obtained by shifting the primary color coordinate based on a white color coordinate corresponding to a color coordinate of the split white data and the target color coordinate, and to compensate for the split primary data based on the shifting color coordinate to generate the compensated primary data.

3. The display apparatus of claim 2, wherein the primary beta value and the white beta value satisfy the following equations of $$MB = \frac{ML}{ML + WL} \text{ and } WB = \frac{WL}{ML + WL},$$

where MB denotes the primary beta value, WB denotes the white beta value, ML denotes the primary luminance value, and WL denotes the white luminance value.

4. The display apparatus of claim 3, wherein an x coordinate, a y coordinate, and a z coordinate of the shifting color coordinate satisfy the following equation of $$\begin{pmatrix} SX \\ SY \\ SZ \end{pmatrix} = \begin{pmatrix} TX - WB \cdot WX \\ TY - WB \cdot WY \\ TZ - WB \cdot WZ \end{pmatrix} \cdot \frac{1}{MB},$$

where SX denotes the x coordinate of the shifting color coordinate, SY denotes the y coordinate of the shifting color coordinate, SZ denotes the z coordinate of the shifting color coordinate, TX denotes an x coordinate of the target color coordinate, TY denotes a y coordinate of the target color coordinate, TZ denotes a z coordinate of the target color coordinate, WX denotes an x coordinate of the white color coordinate, WY denotes a y coordinate of the white color coordinate, and WZ denotes a z coordinate of the white color coordinate.

5. The display apparatus of claim 1, further comprising a scaler configured to analyze the mapping primary data and the mapping white data to calculate a scaling value, and configured to scale down grayscale values of the mapping primary data and the mapping white data in accordance with the scaling value to generate scalar primary data and scalar white data, wherein the splitter is further configured to receive the scalar primary data and the scalar white data, to convert the scalar primary data to the split primary data based on the one gamma curve, and to convert the scalar white data to the split white data based on the another gamma curve.

6. The display apparatus of claim 5, further comprising:

a backlight configured to generate a light; and a backlight controller configured to drive the backlight, wherein the backlight controller is configured to generate a backlight control signal to scale up a luminance of the light generated by the backlight in response to the scaling value.

7. The display apparatus of claim 1, further comprising a renderer configured to sub-pixel render the compensated primary data and compensated white data to respectively generate rendered primary data and rendered white data.

8. The display apparatus of claim 7, wherein the renderer is configured to re-sample the compensated primary data and the compensated white data to respectively generate the rendered primary data and the rendered white data.

9. The display apparatus of claim 8, wherein the red, green, blue, and white sub-pixels are configured to receive data voltages obtained based on different data among respective ones of red, green, and blue image data of the rendered primary data, and the white sub-pixel is configured to receive a data voltage obtained based on the rendered white data.

10. The display apparatus of claim 1, wherein the splitter is configured to generate the split primary data based on the mapping primary data and a first gamma curve within a first period, to generate the split white data based on the mapping white data and a second gamma curve different from the first gamma curve within the first period, to generate the split primary data based on the mapping primary data and the second gamma curve within a second period temporally succeeding the first period, and to generate the split white data based on the mapping white data and the first gamma curve within the second period.

11. The display apparatus of claim 10, wherein each of the first and second periods corresponds to at least n frame, and the "n" is a natural number.

12. The display apparatus of claim 11, wherein the first gamma curve has a luminance value higher than a reference gamma curve at a same grayscale value, the second gamma curve has a luminance value lower than a reference gamma value at a same grayscale value, and the reference gamma value of the reference gamma curve is about 2.2.

13. A method of driving a display apparatus, the method comprising:

mapping primary color data comprising information on three primary colors;

generating mapping primary data comprising red, green, and blue information and mapping white data comprising white information;

generating split primary data based on the mapping primary data and a first gamma curve;

generating split white data based on the mapping white data and a second gamma curve different from the first gamma curve; and compensating the split primary data based on a target color coordinate and a primary color coordinate corresponding to a color coordinate of the split primary data to generate compensated primary data, wherein the compensating the split primary data to generate the compensated primary data further comprises:

calculating a primary luminance value of the split primary data and a white luminance value of the split white data;

calculating a primary beta value based on the primary luminance value;

calculating a white beta value based on the white luminance value; and generating the compensated primary data based on the primary beta value and the white beta value.

14. The method of claim 13, wherein the compensating the split primary data to generate the compensated primary data comprises:

calculating a shifting color coordinate by shifting the primary color coordinate based on a white color coordinate corresponding to a color coordinate of the split white data and the target color coordinate; and compensating the split primary data based on the shifting color coordinate to generate the compensated primary data.

15. The method of claim 14, wherein the primary beta value and the white beta value satisfy the following equations of $$MB = \frac{ML}{ML + WL} \text{ and } WB = \frac{WL}{ML + WL},$$

where MB denotes the primary beta value, WB denotes the white beta value, ML denotes the primary luminance value, and WL denotes the white luminance value.

16. The method of claim 15, wherein a x coordinate, a y coordinate, and a z coordinate of the shifting color coordinate satisfy the following equation of $$\begin{pmatrix} SX \\ SY \\ SZ \end{pmatrix} = \begin{pmatrix} TX - WB \cdot WX \\ TY - WB \cdot WY \\ TZ - WB \cdot WZ \end{pmatrix} \cdot \frac{1}{MB},$$

where SX denotes the x coordinate of the shifting color coordinate, SY denotes the y coordinate of the shifting color coordinate, SZ denotes the z coordinate of the shifting color coordinate, TX denotes an x coordinate of the target color coordinate, TY denotes a y coordinate of the target color coordinate, TZ denotes a z coordinate of the target color coordinate, WX denotes an x coordinate of the white color coordinate, WY denotes a y coordinate of the white color coordinate, and WZ denotes a z coordinate of the white color coordinate.

17. The method of claim 13, wherein the first gamma curve has a luminance value higher than a reference gamma curve at a same grayscale value, the second gamma curve has a luminance value lower than a reference gamma value at a same grayscale value, and the reference gamma value of the reference gamma curve is about 2.2.

* * * * *